US005864288A

United States Patent [19]

Hogan

[11] Patent Number: 5,864,288

[45] Date of Patent: Jan. 26, 1999

[54] TALKING TOOTHBRUSH HOLDER

[76] Inventor: Rory G. Hogan, 15 McShane St., Nth Balwyn, Melbourne, Victoria 3104, Australia

[21] Appl. No.: 946,575

[22] Filed: Oct. 7, 1997

[30] Foreign Application Priority Data

Oct. 11, 1996 [AU] Australia ..... 68115/96

[51] Int. Cl.[6] ..... G08B 13/14

[52] U.S. Cl. ..... 340/568; 340/692; 340/693; 340/332; 434/238; 446/297

[58] Field of Search ..... 340/568, 691, 340/692, 693, 815.65, 309.15, 331, 332; 434/238, 263; 446/268, 297; 368/10; 362/811, 802; 211/65

[56] References Cited

U.S. PATENT DOCUMENTS

| | | | |
|---|---|---|---|
| 2,947,013 | 8/1960 | Silverman | 15/105 |
| 4,285,151 | 8/1981 | Gertler | 434/238 X |
| 4,788,734 | 12/1988 | Bauer | 434/263 X |
| 4,836,415 | 6/1989 | Grussmark | 340/309.15 X |
| 4,866,807 | 9/1989 | Kreit et al. | 434/263 X |
| 5,184,959 | 2/1993 | Oryhon et al. | 434/263 |
| 5,288,233 | 2/1994 | Green | 434/238 |
| 5,335,798 | 8/1994 | Bonwell et al. | 211/65 |
| 5,438,726 | 8/1995 | Leite | 15/105 |
| 5,570,325 | 10/1996 | Arpadi | 368/10 |
| 5,572,762 | 11/1996 | Scheiner | 15/105 |
| 5,733,131 | 3/1998 | Park | 446/268 X |

*Primary Examiner*—Thomas J. Mullen, Jr.
*Attorney, Agent, or Firm*—Robert Platt Bell & Associates, P.C.

[57] ABSTRACT

A tooth brush holder adapted to contain at least one tooth brush is provided with a switch and circuitry such that when the tooth brush is removed from the holder a sound producing device is actuated which device can continue to produce sound for at least a predetermined time. In one preferred form of the invention, the sound producing device may incorporate an audio chip on which a pre-recorded message is located and, in a second form, may include a recordable chip recorded by a user or some other person. The apparatus may be provided with a control apparatus to monitor the amount of time the toothbrush has been removed from the holder to insure that proper brushing has taken place. If the toothbrush is replaced in the holder before the predetermined time period has elapsed, a warning message or tone (and/or light) may be activated advising the user that more brushing is needed. An indicator may be activated to alert a parent or other adult that brushing has not occurred (or has not occurred by a certain time of day) or that brushing was inadequate. If the toothbrush is replaced after the predetermined time period has elapsed (and/or message has been played) an audio or visual reward may be generated. An audio message praising the child may be played (e.g., song or the like) and/or other stimuli may be used (e.g., lights in eyes may flash, animated character elements may move).

20 Claims, 8 Drawing Sheets

TALKING TOOTHBRUSH HOLDER

FIELD OF THE INVENTION

This invention relates to a tooth brush holder and in particular to a tooth brush holder which can be used, inter alia, to train children to brush their teeth for a predetermined time, but can also have other applications.

BACKGROUND OF THE INVENTION

With the advent of fluoridated toothpaste and fluoridated water, the incidence of cavities in children and adults has dropped dramatically. However, the need for proper oral hygiene remains paramount. Proper brushing insures that cavities will remain few, and moreover, reduces the likelihood of gum diseases such as gingivitis and the like.

Parents may not have sufficient time or energy to properly supervise their children's brushing habits on a regular basis. Children, even after being instructed in proper brushing techniques, may lapse into a more lackadaisical schedule without constant supervision and instruction from adults. The reasons are relatively simple. Tooth brushing is a relatively boring and unpleasant task, and children have largely short attention spans. As a result, a child is often likely to be distracted by a television programme, video game, or the like, and may foreshorten brushing, if not foregoing it altogether.

There have been proposed many different forms of tooth brush holders which are normally adapted to be connected to a vertical surface although, in some cases, they are associated with a glass and these have, quite generally, served their primary purpose quite effectively. One such prior art toothbrush holder, Gertler, U.S. Pat. No. 4,285,151, goes one step further by providing a recorded message which is played when a toothbrush is removed from the holder.

The recorded message in Gertler may comprise a melody or message or combination, which may be used to encourage proper oral hygiene (Gertler, Col. 3, lines 28–35). However, the apparatus of Gertler has some limitations. In particular, gertler uses a primitive recording disk or tape which may only play one message. Moreover, the primitive on/off switch of Gertler only serves to initiates playback of the message when brushing starts. If the toothbrush is replaced prematurely, the message continues to play to the end of the melody or message in progress.

Moreover, the apparatus of Gertler is rather bulky, relying upon a recording disk system located in the base. In a typical bathroom, shelf or counter space at a vanity or sink may be at a premium, and consumers may dislike clutter in the bathroom. The large base of Gertler may occupy too much space to make the apparatus acceptable to consumers.

SUMMARY OF THE INVENTION

It is the object of the present invention to provide the tooth brush holder which can provide a secondary purpose.

The invention, in its broadest sense, comprises a tooth brush holder adapted to contain at least one tooth brush and having therein means such that when the tooth brush is removed from the holder a sound producing device is actuated which device can continue to produce sound for at least a predetermined time.

In one preferred form of the invention, the sound producing device may incorporate an audio chip on which a pre-recorded message is located and, in a second form, may comprise a tape recorder which may be able to be recorded by the user or some other person.

The apparatus of the present invention may be provided with a control apparatus to monitor the amount of time the toothbrush has been removed from the holder to insure that proper brushing has taken place. If the toothbrush is replaced in the holder before the predetermined time period has elapsed, a warning message or tone (and/or light) may be activated advising the user that more brushing is needed. An indicator may be activated to alert a parent or other adult that brushing has not occurred (or has not occurred by a certain time of day) or that brushing was inadequate.

If the toothbrush is replaced after the predetermined time period has elapsed (and/or message has been played) an audio or visual reward may be generated. An audio message praising the child may be played (e.g., song or the like) and/or other stimuli may be used (e.g., lights in eyes may flash, animated character elements may move).

BRIEF DESCRIPTIONS OF THE DRAWINGS

In order that the invention may be more readily understood, we shall describe certain embodiments of tooth brush holder made in accordance with the invention in terms of the accompanying drawings.

DETAILED DESCRIPTION OF THE INVENTION

Figure 1:
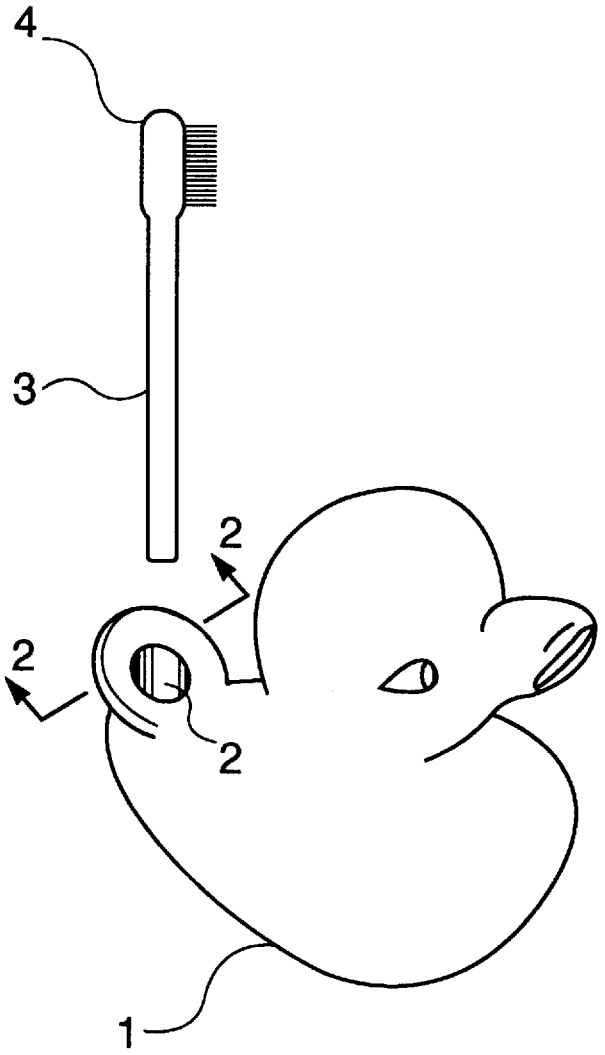
FIG. 1 is a perspective view of a first embodiment of the tooth brush holder of the present invention.
Figure 2:
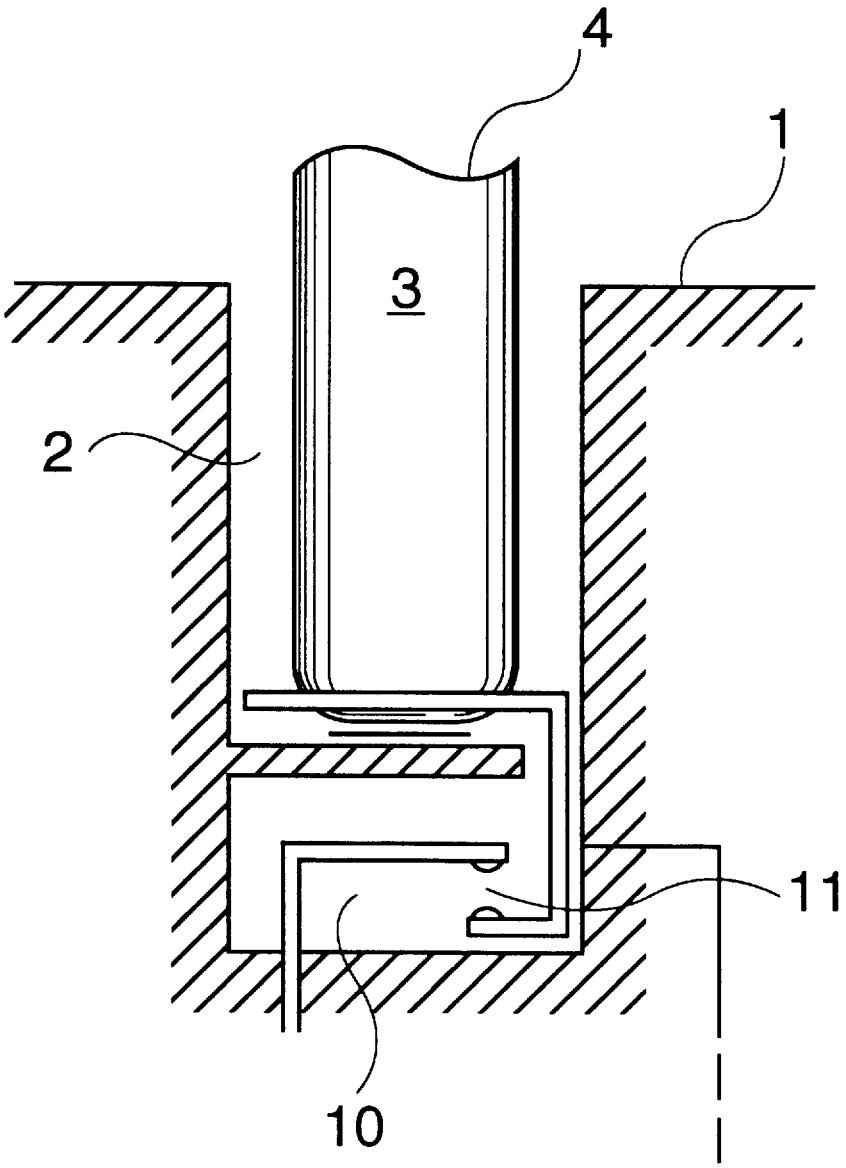
FIG. 2 is a cross-sectional view of the tooth brush holder of FIG. 1 along line 2-2.
Figure 3:
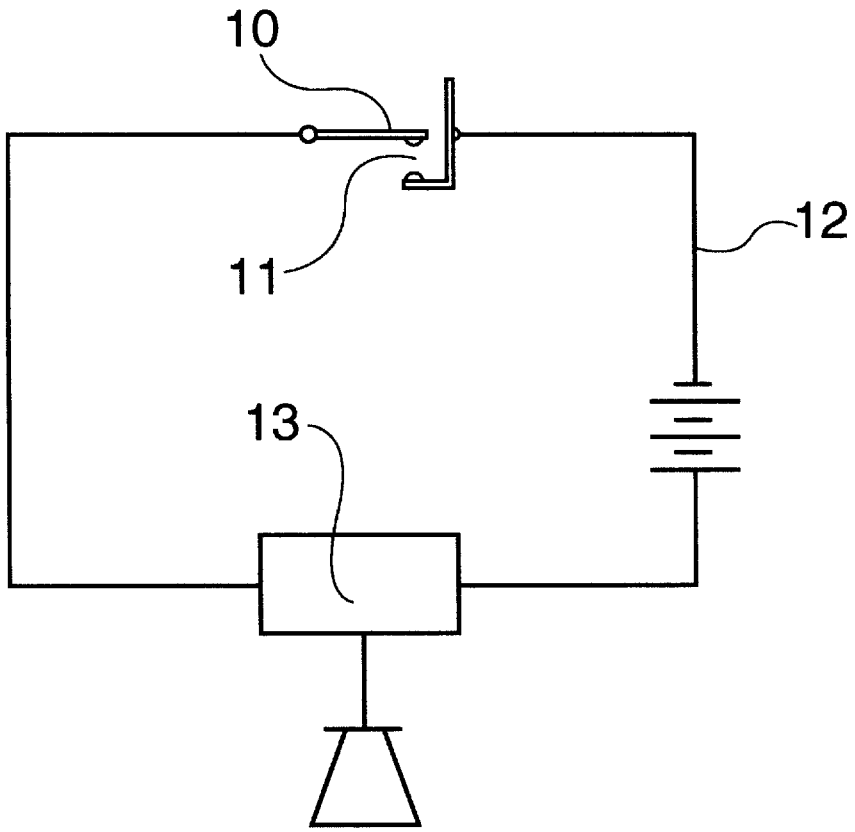
FIG. 3 is a simplified schematic drawing of the electrical circuit contained in the tooth brush holder of FIG. 1.

Referring now to FIGS. 1–3, FIG. 1 illustrates a holder 1 for a single tooth brush 4 and then discuss possible alternatives. In holder 1, tooth brush 4 is received, in the normal way, with its handle 3 passing through an aperture 2 in the holder 1 with the weight of tooth brush 4 acting to open switch 10.

When tooth brush 4 is removed, switch contacts 11 are made such that they initiate a sound circuit 12 having a chip 13 with a pre-recorded message. Such audio or voice generation chips are well known in the art and have been incorporated into various toys, games, and even greeting cards known in the art.

The message generated by chip 13 may take one of a number of forms. In the simplest form, in particular in the use for children, the message can be a somewhat repetitive message about the benefits of scrubbing the teeth, and preferably how to clean them properly with the message being adapted to continue for a predetermined time, say a minute and a half or two and a half minutes to effect a timing of the teeth cleaning operation.

Instead of having a message which simply relates to the cleaning of the teeth, the message could in fact be a story, possibly about cleanliness of teeth which runs for the required length of time.

In a still further embodiment, the message may in fact be a piece of music or the like which, again, runs for the predetermined time so that the user of the holder continues to brush his or her teeth until the music ceases.

In this form of holder, the chip 13 bearing the audio information may be able to be replaced so that at intervals a child's parent can incorporate a new message which maintains the interest of the user.

Alternatively, the chip 13 may include a number of different messages and these may either be played in sequence, or randomly, so that the user does not get overly bored with the material coming from the holder.

Where the chip 13 is replaceable, then it is possible to modify the message depending upon the age of the user so that as a child grows up the messages that it receives can be varied.

If the tooth brush holder 1 is a multiple brush holder, it may be that each of the toothbrush receiving portions may actuate a switch which initiates the same message, so that whenever a person cleans his or her teeth, he or she receives the same message, or a message from a set of messages, as each other person.

Alternatively, the messages could be graduated by replacement of chips so that different people get messages which are more appropriate to them than to other members of the group whose tooth brushes are held in the holder.

In the further form of the invention, it is possible that the message or messages can be retained on a micro tape and these tapes may be recordable, either while in position in the tooth brush holder or away therefrom so that a person, either the user of the tooth brush or some other person, could record a message which is relevant to the person using the tooth brush.

Thus, a parent could, for example, leave a message for a child which is particularly applicable for the child or could even leave a message for a spouse or other adult which could be informative, entertaining, amusing or any other required form of message.

In the earlier part of the specification, the audio device is described as being operated by a switch which ascertains the existence or non-existence of the weight of the tooth brush on the holder. Alternatively, other forms of switching devices may be utilized. For example a lever switch, photoelectric, magnetic (e.g., reed switch, Hall effect, or other type of proximity switch), inductive, or other type of switch may be used to provide a waterproof and reliable connection.

Figure 5:
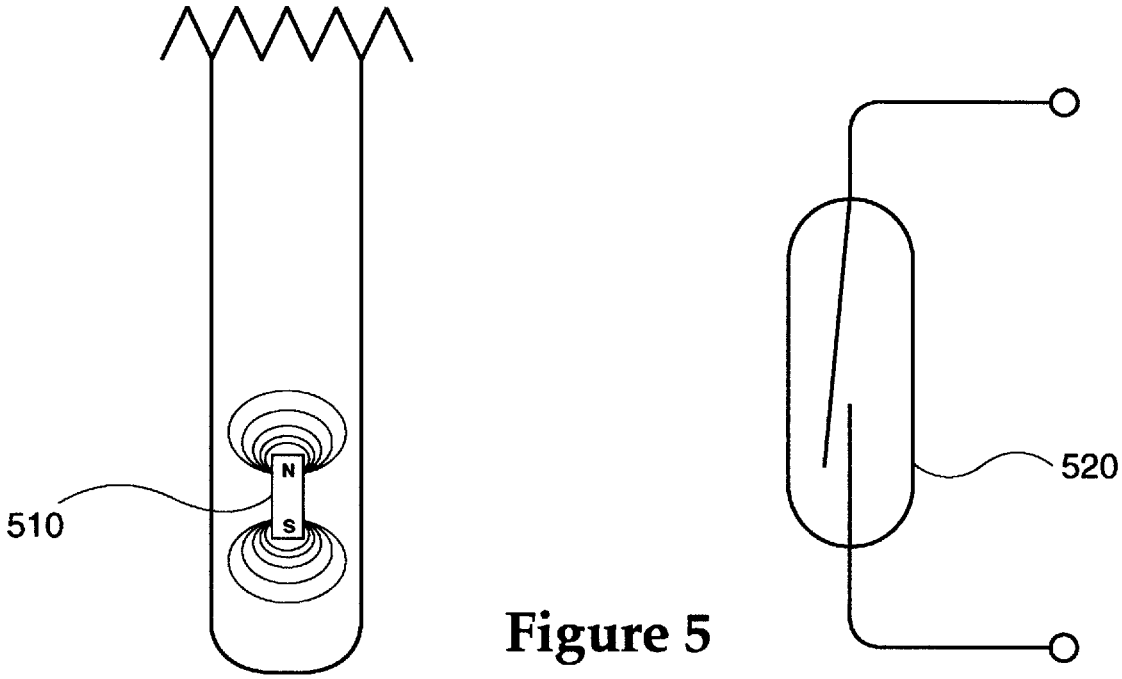
FIG. 5 illustrates the use of a reed type switch and magnet to trigger the present invention.

In addition, the toothbrush may be provided with a specialized base or insert (e.g., magnet or the like) designed to directly interface with the apparatus of the present invention, as illustrated in FIG. 5. Thus, for example, toothbrush 510 may be provided with a small embedded magnet which triggers magnetic reed switch 520 to activate or deactivate the apparatus. Such reed switches are well known in the art (e.g., house alarms and the like) and may be readily applied to the present invention.

Figure 6:
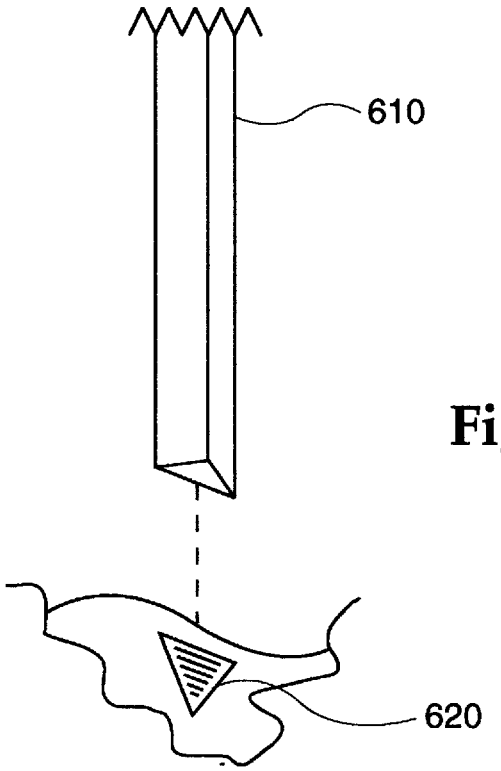
FIG. 6 illustrates how a specially shaped or adapted end on the toothbrush may be used to trigger the present invention.

Alternately, as illustrated in FIG. 6, the handle of toothbrush 610 may be provided with a predetermined shape (e.g., triangular as illustrated in the Figure) which may interlock with an orifice 620 containing a switch. By providing a proprietary interface shape or magnet, the provider of the apparatus of the present invention may insure that toothbrush purchasers will purchase only those toothbrushes recommended and endorsed by the manufacturer. In addition, such switching devices may be suitably implemented to identify which of a number of users is using the device in a multiple toothbrush embodiment.

Alternatively, other forms of switching could be used. For example, there could be a light beam or a laser beam which is interrupted by the tooth brush when it is being removed, or alternatively, is permitted to strike a receptor after the tooth brush has been removed to cause initiation of the sound. Any such method of switching which can be operated by the movement of a toothbrush may be implemented without departing from the spirit and scope of the present invention.

Similarly, in the specification there is mentioned certain different ways of producing the sound to emanate from the tooth brush holder. These are not necessarily exclusive as any other method of producing sound would be perfectly satisfactory without departing from the spirit and scope of the present invention. For example, it would be possible that the removal of the tooth brush actuates a radio receiver and permits the radio to play for the required time so that the user can ensure that his or her teeth have been properly cleaned.

If this type of device is being used, it may be that at the end of the time there could be an audible, or even possibly a visual alarm, so that the radio can continue to play while the user is having a shower, after it has served its initial purpose to time the cleaning operation.

The tooth brush holder could also be provided with a switch or a button for an emergency message, which may be initiated if there were bleeding of the gums or a chipped tooth or pain. The emergency switch would normally carry a message that was designed to indicate that the matter is of some urgency but at the same time indicating that most problems with teeth can be cured provided action is taken rapidly and suggesting that the person concerned immediately have his or her parents contact their dentist so that the situation can be assessed. The actual form of such message and whether or not there is one or more messages could depend on the particular product being produced.

Figure 4:
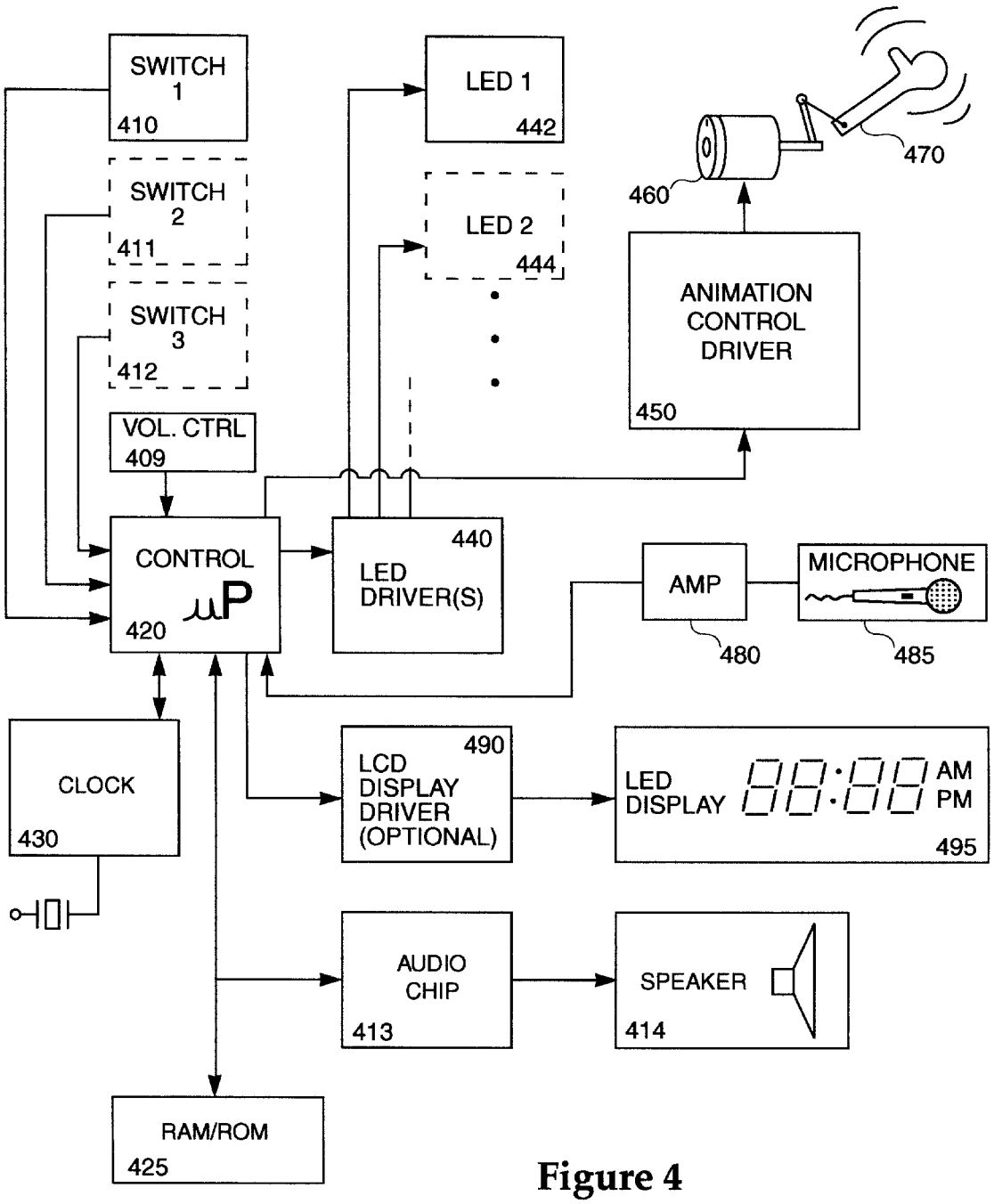
FIG. 4 is a block diagram of a second embodiment of the present invention.

FIG. 4 is a block diagram of a second embodiment of the present invention. In the apparatus of FIG. 4, the audio chip 13 of FIG. 3 may be augmented by other circuitry in order to enhance the features and operability of the present invention. All of the elements of FIG. 4 may be provided as discrete components, or may be provided in a unitary custom ASIC or the like.

In the apparatus of FIG. 4, a microprocessor or controller 420 may be utilized to control a number of functions within the device. Microprocessor or controller 420 may comprise, for example, an Intel® 8050 series controller IC, or a Motorola® 6800 series controller IC, both of which are popular controllers for process control applications.

Microprocessor or controller 420 may be provided with an internal or externally loaded program which may be stored in RAM or ROM memory 425. The program may direct control of various elements of the present invention as described below in connection with FIGS. 7 and 8.

A number of switches 410, 411, and 412 may be provided along the lines of switch 10 discussed above in connection with FIG. 3. Switches 410, 411, and 412 may comprise switches for sensing the removal of a toothbrush and/or an electric toothbrush body. Alternately, one or more of switches 410, 411, 412 may comprise manual switches to allow a user to program or otherwise set or reset the device.

Figure 8:
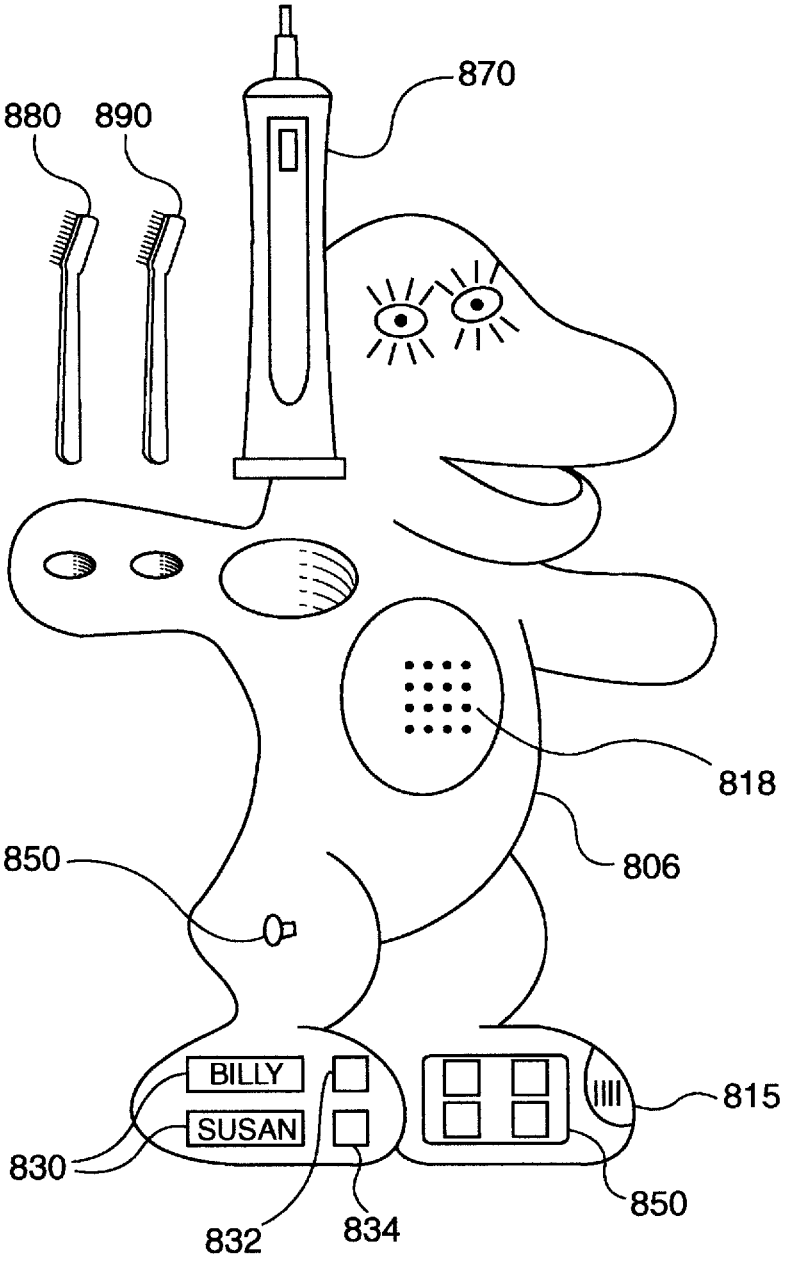
FIG. 8 is a perspective view of a third embodiment of the present invention.

In the preferred embodiment, as illustrated in FIG. 8, switches 410 and 411 may sense removal of toothbrush heads 880 and 890, and switch 412 may sense removal of the electric toothbrush body 870. It should be noted that in addition to sensing removal of these items, any one of switches 410,411, and 412 may also be used for programming or the like through use of a predetermined pattern of switching. For example, removing toothbrush head 880 three times in quick succession may place the apparatus in a program mode to allow for recording of messages, setting of the clock or the like. In this manner, the number of switches 410, 411, and 412 may be minimized.

It should also be noted that additional switches may also be provided for additional toothbrush heads and the like. In addition, a volume control switch or knob 409 may be provided to control audio output of audio chip 413. Volume control may be provided by two switches which may be pressed to increase or decrease volume, respectively, or by a potentiometer or other type of volume control switch known in the art. In an alternative embodiment, a potentiometer may be inserted between audio chip 412 and speaker 413 to control volume in an analog fashion.

Figure 9:
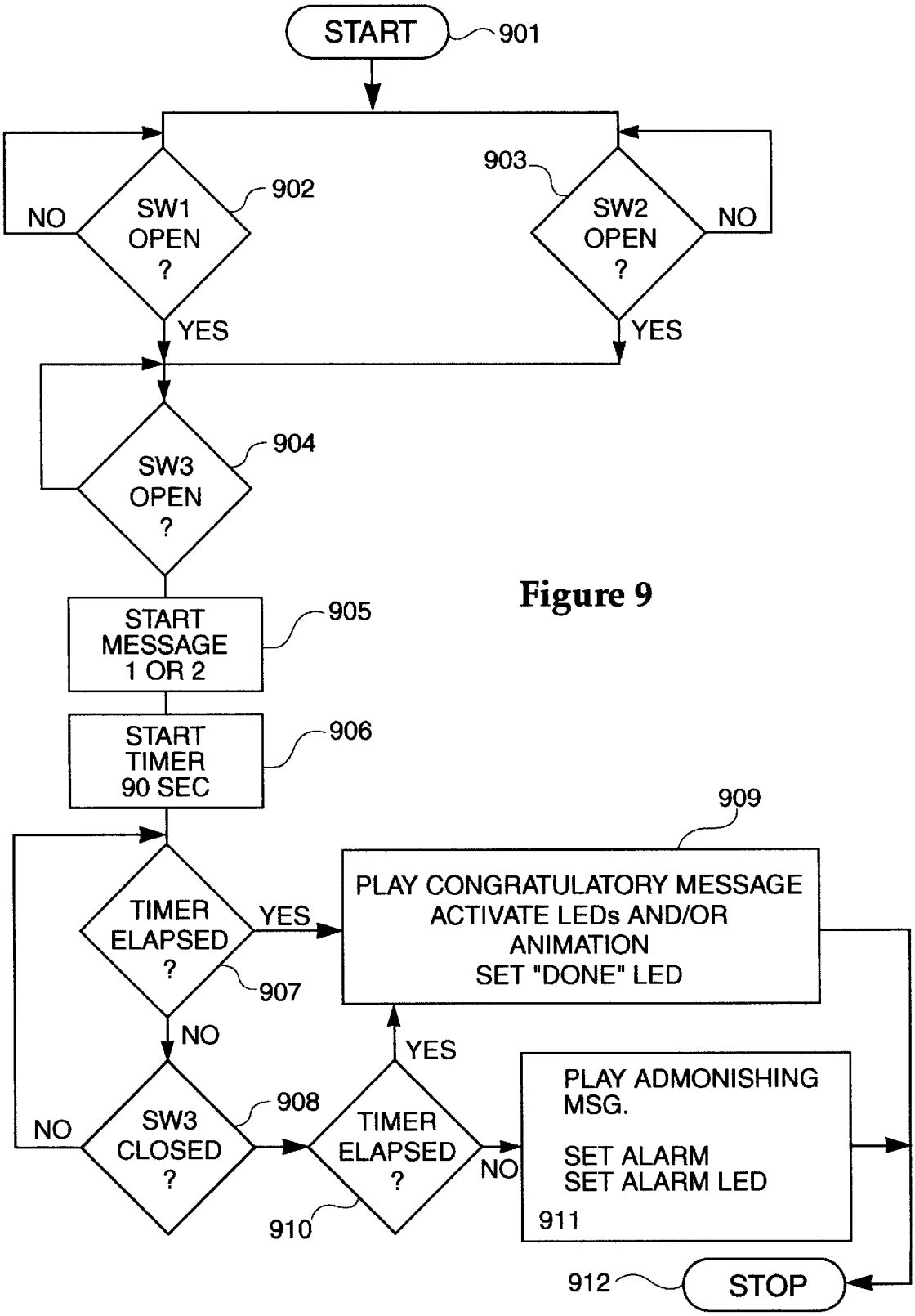
FIG. 9 is a flowchart illustrating the steps of operation of microcontroller or controller 420 of FIG. 4.

Once one or more of switches 410, 411, and 412 are activated, microprocessor or controller 410 may initiate a program as illustrated in FIG. 9. In FIG. 9, it is assumed that three switches 410, 411, and 412 may be implemented as illustrated in FIG. 8. In steps 902 and 903, switches SW 1 (410) and SW 2 (411) are monitored to determine whether one of two toothbrush heads 880 or 890 are removed from the apparatus. In step 903, switch SW 3 (412) may be monitored to determine whether the electric toothbrush body 870 has been removed. It may be noted that in a non-electric toothbrush embodiment, switch SW 3 may be removed and programming suitably altered.

Once toothbrush body 870 has been removed, a message may be played as illustrated in step 905. Such a message may be customized or different for each user, as selected by switch SW 1 (410) or switch SW 2 (411) corresponding to toothbrush heads 880 and 890, respectively. The messages may be digitally stored in RAM or ROM memory 425. RAM or ROM memory 425 may comprise any one of known RAM, ROM, DRAM, PROM, EPROM, EEPROM, flash memory, or other type of memory known in the art. Audio chip 413 may convert the stored message into analog form for playback through speaker 414. Speaker 414 may playback the sound through grill 818 or the like.

In step 906, a 90 second (or other appropriate time base) timer may be started. The timer may operate within microprocessor or controller 410 as clocked by clock control circuit 430. Clock control circuit 430 may also generate clock signals for maintaining the time of day and date for display on LED display 495 through LED display driver 490. When not in use, the apparatus of the present invention may display the current time. When activated, LED display 495 may display a countdown clock or the like, as illustrated by counter display 850 in FIG. 8. Counter display 850 may be substituted with a four digit AM/PM clock display as illustrated in FIG. 4 as display 495. In the alternative, no clock display may be provided.

Display 495 may alternatively be expanded to include an alphanumeric display which may display text or other messages in conjunction with the overall operation of the present invention. For example, such messages may encourage brushing, or address the child or user by name. In addition, primitive animation may be possible using such alphanumeric or LED displays.

In step 907, it is determined whether the countdown clock has yet elapsed. If not, processing passes to step 908. In step 908, it is determined whether switch SW 3 (412) or other switch corresponding to a removed toothbrush head has been closed. If not, processing passes back to step 907 in an iterative loop. If switch SW 3 (412) has been closed, processing passes to step 910 to determine whether the countdown timer has elapsed. If so, in step 909 a congratulatory message or song may be played, and a number of positive reinforcement steps taken.

Figure 7:
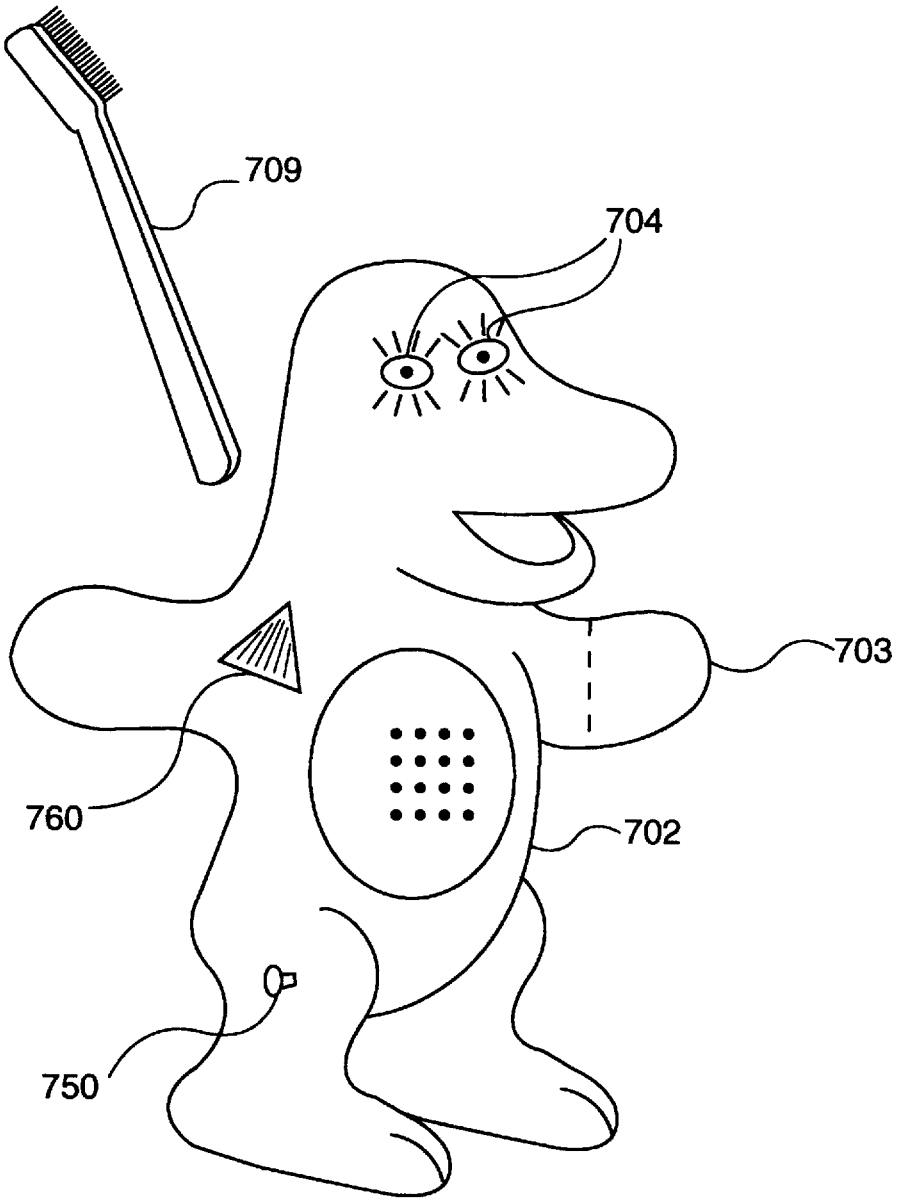
FIG. 7 is a perspective view of a second embodiment of the present invention.

For example, in step 909, LEDs 704 placed in the eyes of character 702 may flash, as illustrated in FIG. 7. In addition, the character may perform some sort of animated move or moves, illustrated in FIG. 7 as an arm 703 waving. Animation control driver 450 may be interfaced with microprocessor or controller 420 to drive (through suitable power transistors or the like) a motor 460 which may control animate through suitable linkage 470.

Similarly, LEDs 442, 444 and the like may be driven by LED driver(s) 440. The number and type of LEDs used may vary depending upon application. For example, round single-colour LEDs may be used for flashing eyes 704, whereas multi-colour (e.g., red, yellow, green) LEDs may be used for indicators 832 and 834 illustrated in FIG. 8. LEDs 832 and 834 in FIG. 8 may be placed alongside name tags 830 in which a user (e.g., child) may write his or her name. When the toothbrushing cycle is properly completed, as illustrated in step 909, a corresponding LED may light green to illustrate that brushing has taken place.

If the brushing cycle is interrupted before completion, as illustrated in step 911, an admonishing message may be played, an alarm sounded, and corresponding LED 832 or 834 may light or flash red, indicating to a parent that brushing has not taken place or was incorrectly done.

Clock circuit 430, in addition to providing a clock display 495, may also be used to encourage brushing at certain times of day. For example, each morning at a predetermined (and/or programmable) time, a message may be automatically be played which encourages children to brush. In addition, LEDs 832 and 834 may light or flash yellow, indicating that brushing has yet to take place that morning.

The apparatus may similarly be programmed to perform the same function at noon or in the evening, to encourage brushing three times a day.

In addition, after a predetermined time period (e.g., 2 months) the apparatus may play a message encouraging the user to buy new toothbrush heads or the like. In the alternative, the apparatus may use a simple timer circuit to measure a predetermined time period between brushings (e.g., 6–8 hours), thus avoiding the necessity for a user to set and program a clock circuit.

Microphone 485 provided behind grill 815 may be used to record messages. Amplifier 480 may amplify such received analog signals which may in turn be converted into digital form in microprocessor or controller 420 (e.g., Intel® 9800 series with built-in A/D conversion) and stored in RAM and/or ROM memory 425. Personalized messages may be thus stored for each child or user.

Referring again to FIG. 7, the apparatus of FIG. 7 illustrates a simplified embodiment of the present invention employing animation. The apparatus may be table or wall mounted (e.g. through screws, suction cups or the like). Character 702 may be provided with an orifice 760 for holding a toothbrush 709 here illustrated as a manual toothbrush. Orifice 760 may be provided to containing the switching elements of FIGS. 2, 5, or 6 or the like. Animated arm 703 may be activated as discussed above as a reward for proper brushing. LEDs 704 may be placed in the eyes of character 702 to flash as a reward and/or to indicate brushing has occurred. Volume control 750 may be provided to allow a user to control audio output.

Character 702 may be relatively compact in size and thus may not require a lot of space on a vanity or countertop. Character 702 may be wall mounted using a suction cup (not shown) or the like (e.g., velcro strip, wall bracket, adhesive tape). A suction cup may allow character 702 to be mounted to a backsplash or mirror and thus require little or no room on a vanity or sink top. The apparatus of FIG. 7 may be suitably battery powered (e.g., two to four "AA" batteries or the like) to eliminate the need for bulky electrical cords and associated dangers thereof in the bath.

FIG. 8 illustrates a more complex embodiment of the present invention. It should be appreciated that elements of the embodiments of FIGS. 1, 7, and 8 may be selectively applied to produce an apparatus having specific features and price points. In the embodiment of FIG. 8, power may be supplied through mains 820, which may incorporate a ground-fault interrupt circuit, or the apparatus may be battery operated as in FIG. 7. The apparatus of FIG. 8 is illustrated as being used with an electric toothbrush of the type sold by the Braun® corporation under the trademark ORAL-B®.

However, the Braun® toothbrush of FIG. 8 is for purposes of illustration only, and other types of electric and non-electric toothbrushes may be utilized without departing from the spirit and scope of the present invention. The Braun® device does incorporate indicative charging capabilities, as well as a sealed indicative proximity sensing device to sense with electric toothbrush body 870 has been removed from its base. Thus, the technology of that device may be readily adapted to the present invention.

Character 860 may comprise a fanciful character, or any one of a number of known licensed characters popular with children. Alternately, no character need be provided, for example, for an adult application, or in the alternative, an adult application may use a character or embodiment suitable for adults (e.g., Cindy Crawford or Brad Pitt type character).

Although described herein as being used for children, the present invention may also be applied for adults and as a medical device. For example, the present invention may be used to instruct adults in proper brushing techniques, or in specialized techniques (e.g., fluoride treatments or the like) where materials (e.g., fluoride gel or the like) need be applied for a particular period of time. In addition, other oral hygiene, general hygiene, or medical procedures may be coached or instructed (e.g., flossing).

While the preferred embodiment and various alternative embodiments of the invention have been disclosed and described in detail herein, it may be apparent to those skilled in the art that various changes in form and detail may be made therein without departing from the spirit and scope thereof.

What is claimed is:

1. An apparatus comprising:

sensing means for detecting the presence and absence of at least one toothbrush portion and outputting a first signal indicating absence of the at least one toothbrush portion;

control means, coupled to the sensing means, for receiving the first signal indicating absence of the at least one toothbrush portion and for actuating a predetermined program in response to the signal;

sound generating means, coupled to the control means, for generating predetermined sound patterns in response to control signals from the control means; and timing means, coupled to the control means, for timing a predetermined period from assertion of the first signal indicating the absence of the at least one toothbrush portion and asserting a second signal to the control means when the predetermined period has elapsed, wherein said control means outputs a first control signal to said sound generating means for generating a first predetermined sound pattern when the first signal indicating the absence of the at least one toothbrush portion is asserted, and outputs a second control signal to said sound generating means for generating a second predetermined sound pattern when the first signal indicating the absence of the at least one toothbrush portion is de-asserted and the second signal is asserted.

2. The apparatus of claim 1, wherein said control means outputs a third control signal to said sound generating means for generating a third predetermined sound pattern when the first signal indicating the absence of the at least one toothbrush portion is de-asserted and the second signal is de-asserted.

3. The apparatus of claim 2, wherein said sound generating means comprises a microchip for generating a sound pattern from a digitally stored sound pattern.

4. The apparatus of claim 3, further comprising:

at least one light generating means, coupled to the control means, for generating light in response to the second control signal.

5. The apparatus of claim 4, wherein said at least one light generating means generates a first coloured light in response to the first control signal, and a second coloured light in response to the second control signal, and a third coloured light in response to the third control signal.

6. The apparatus of claim 5, wherein the first sound pattern comprises a message encouraging a user to brush.

7. The apparatus of claim 6 wherein the second sound pattern comprises a message congratulating a user for brushing properly.

8. The apparatus of claim 7, wherein the third sound pattern comprises a message admonishing a user for not brushing long enough.

9. The apparatus of claim 8 wherein said sensing means comprises a contact switch.

10. The apparatus of claim 8 wherein said sensing means comprises a magnetic reed switch and said at least one toothbrush portion includes a magnet for actuating said magnetic reed switch when said at least one toothbrush portion is placed in proximity to the magnetic reed switch.

11. The apparatus of claim 8 wherein said sensing means comprises a Hall effect switch and said at least one toothbrush portion includes a magnet for actuating said Hall effect switch when said at least one toothbrush portion is placed in proximity to the Hall effect switch.

12. The apparatus of claim 8, wherein said at least one toothbrush portion includes a portion for selectively engaging said sensing means to as to activate said sensing means when engaged.

13. The apparatus of claim 8, further comprising:

an alphanumeric display means, coupled to the control means, for displaying an alphanumeric message in response to control signals from the control means.

14. The apparatus of claim 13, wherein said alphanumeric display means displays a countdown timer in response to the first control signal, the countdown timer displaying an amount of time until the predetermined time period has elapsed.

15. The apparatus of claim 14, wherein said alphanumeric display means displays a first message in response to the second control signal.

16. The apparatus of claim 15, wherein said alphanumeric display means displays a second message in response to the third control signal.

17. The apparatus of claim 16, wherein said alphanumeric display means displays time of day in the absence of the first, second, and third control signals.

18. The apparatus of claim 4, further comprising:

a three-dimensional character figure having at least one movable appendage;

actuator means, coupled to the at least one movable appendage and coupled to the control means, for moving the at least one movable appendage in response to the second control signal.

19. The apparatus of claim 18, wherein said at least one light generating means comprises a pair of light emitting diodes provided as eyes for the three-dimensional character figure, said pair of light emitting diodes flashing in response to the second control signal.

20. The apparatus of claim 3, further comprising:

a microphone, coupled to said control means, for recording input sound patterns into memory for use as predetermined sound patterns.

* * * * *